US006297599B1

(12) United States Patent
Dirscherl et al.

(10) Patent No.: US 6,297,599 B1
(45) Date of Patent: Oct. 2, 2001

(54) DIELECTRIC BARRIER DISCHARGE LAMP WITH A SEGMENTED ELECTRODE

(75) Inventors: Jürgen Dirscherl, Hasloch/Main; Markus Klein, Freiburg; Robert P. Scholl, Roetgen, all of (DE)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/527,287

(22) Filed: Mar. 17, 2000

(30) Foreign Application Priority Data

Mar. 25, 1999 (EP) ..... 99200924

(51) Int. Cl.[7] ..... H05B 41/00

(52) U.S. Cl. ..... 315/260; 315/246; 313/497; 313/607

(58) Field of Search ..... 315/246, 250, 315/260, 244, 270; 313/497, 607, 234, 485, 570

(56) References Cited

U.S. PATENT DOCUMENTS

| | | | | |
|---|---|---|---|---|
| 5,343,114 | | 8/1994 | Beneking et al. | 313/485 |
| 5,604,410 | * | 2/1997 | Vollkommer et al. | 315/246 |
| 5,965,988 | * | 10/1999 | Vollkommer et al. | 315/246 |
| 5,994,849 | * | 11/1999 | Vollkommer et al. | 315/246 |

* cited by examiner

*Primary Examiner*—Don Wong
*Assistant Examiner*—Wilson Lee
(74) *Attorney, Agent, or Firm*—Dicran Halajian

(57) ABSTRACT

Lighting apparatus includes a dielectric barrier discharge lamp having a discharge vessel enclosing a discharge space having a filling, first and second main electrodes, a dielectric sheet between the first main electrode and the discharge space, and a first circuit part for generating an operating voltage between the main electrodes. A plurality of electrode bodies mounted in or on the dielectric sheet form an auxiliary electrode, and a second circuit part generates auxiliary voltages between the electrode bodies for generating an auxiliary discharge in the discharge space.

20 Claims, 2 Drawing Sheets

DIELECTRIC BARRIER DISCHARGE LAMP WITH A SEGMENTED ELECTRODE

BACKGROUND OF THE INVENTION

The invention relates to a lighting arrangement equipped with a dielectric barrier discharge lamp comprising

- a gas tight discharge vessel enclosing a discharge space and containing a filling,
- a first main electrode and a second main electrode,
- a dielectric sheet situated between the first main electrode and the discharge space,
- a circuit arrangement coupled to the main electrodes for igniting and operating the dielectric barrier discharge lamp, comprising
  - a first circuit part for generating an operating voltage that is present between the two main electrodes.

The invention also relates to a dielectric barrier discharge lamp.

A lighting arrangement as described above is known from U.S. Pat. No. 5,343,114. The dielectric barrier discharge that is present in the discharge space during operation of the known lighting arrangement is a high very suitable for the generation of excimers or ozone. The filling typically contains one or more noble gases, a metal halide or a metal vapor and traces of other gases for excimers generation or a mixture of oxygen or air with other gases for the generation of ozone. A discharge is maintained by applying a high voltage between the first and second main electrode. The dielectric sheet that covers the first main electrode serves to distribute the discharge over the electrode area and to interrupt the discharge at an early stage due to the build up of an electrical field by charge accumulation on the dielectric sheet. The electrical field counteracts the electrical field present between the two main electrodes. Due to the early interruption of the discharge, the dielectric barrier discharge lamp (further also called lamp) has to be operated with a high frequency AC operating voltage and the discharge is far from equilibrium. This latter property of the discharge together with a suitable filling allows efficient generation of excimers. Excimers are a source of UV radiation. This UV radiation can for instance be used in photochemical processes. Dielectric barrier discharges are also often used to generate ozon. Alternatively, by making use of a suitable luminescent material, this UV radiation can be converted into visible radiation. A disadvantage of the known lighting arrangement, however, is the very high amplitude of the operating voltage necessary to reignite the dielectric barrier discharge lamp at the beginning of each half period of the operating voltage. In fact this high amplitude of the operating voltage raises the requirements that the circuit arrangement for operating the lamp has to meet to such an extent, that it forms the main impediment for a much more widespread use of the lighting arrangement.

SUMMARY OF THE INVENTION

According to the invention the dielectric barrier discharge lamp further comprises auxiliary electrode means and the circuit arrangement further comprises a second circuit part coupled to the auxiliary electrode means for generating an auxiliary discharge in the discharge space.

The auxiliary electrode means are so constructed that the second circuit part only needs to apply an auxiliary voltage with a relatively low amplitude to it in order to generate the auxiliary discharge. The auxiliary discharge generates free electrons and other charged particles. Because of the presence of these free electrons and other charged particles a discharge between the two main electrodes can be established by applying an operating voltage with only a relatively low amplitude between them. In other words the dielectric barrier discharge lamp can be operated making use of an operating voltage with only a relatively low amplitude.

The auxiliary electrode means may comprise a number n of electrode bodies, n being bigger than or equal to 2 . In that case the second circuit part may comprise means for generating n−1 auxiliary voltages that are present between neighbouring electrode bodies and that during operation cause a discharge to be present between neighboring electrode bodies. Preferably all these n−1 auxiliary voltages have the same amplitude, so that the second circuit part only needs to generate one voltage that is applied to each of the n−1 pairs of neighbouring electrode bodies.

Alternatively, the auxiliary electrode means may comprise a number n of electrode bodies, while the second circuit part comprises means for generating n auxiliary voltages that are present between the electrode bodies and the surrounding discharge space during ignition. During operation these voltages generate discharges that are known as corona discharges. Preferably all these n auxiliary voltages have the same amplitude, so that the second circuit part only needs to generate one voltage that is applied to each of the n electrode bodies. The number n of electrode bodies can in this case be equal to 1. An important advantage of embodiments in which one or more corona discharges are used as auxiliary discharge, is that the first and the second circuit part can be integrated.

The electrode bodies can be mounted in or on the dielectric sheet. Good results have been obtained for embodiments of a lighting arrangement according to the invention, wherein the electrode bodies are evenly distributed over the dielectric sheet. During stationary operation the auxiliary discharge maintained by the electrode bodies is also evenly distributed over the dielectric sheet. As a result the homogeneity of the main discharge remains intact.

More in particular in case the auxiliary discharge consists of Corona discharges, the electrode bodies may protrude from the dielectric sheet into the discharge space.

Alternatively, the electrode bodies may be separated from the discharge space by means of the dielectric sheet. In this case the electrode bodies are not in contact with the filling. Depending on the nature of the filling and the material that is used to construct the electrode bodies this construction may prevent deterioration of the electrode bodies or changes in the composition of the filling.

In a preferred embodiment one of the main electrodes comprises n electrode segments and the electrode bodies of the auxiliary electrode means are formed by the electrode segments. In this preferred embodiment both the main electrodes and the auxiliary electrodes are formed out of the same amount of electrode material. In case n=1 there is only one electrode body comprised in the auxiliary electrode means and this electrode body is formed by one of the main electrodes.

Alternatively, one of the main electrodes may comprise n electrode segments while the electrode bodies are separate from the electrode segments and each of the electrode bodies is electrically connected to an electrode segment. This construction of the main electrodes and the auxiliary electrodes allows the auxiliary voltage to be applied via the electrode segments, so that the electrical connections can be relatively simple. In this construction n can be chosen equal to 1, in other words the dielectric barrier discharge lamp may comprise only one electrode body in the auxiliary electrode means, while this electrode body is connected to a main electrode that consists of one segment only.

In a further preferred embodiment of a lighting arrangement the second circuit part comprises selection means for selecting a number of electrode bodies and for coupling the auxiliary voltage to the selected electrode bodies only. During operation of this embodiment the auxiliary discharge will only be present in the vicinity of the selected electrode bodies. As a consequence also the main discharge between the two main electrodes will only be established in the vicinity of the selected electrode bodies. The selection means can thus be used to control the light output of the lamp by determining the size of the discharge between the two main electrodes. Alternatively the selection means can be used for color variation, by coating different parts of the wall of the discharge vessel with different luminescent materials and by subsequently establishing the discharge between the two main electrodes in said different parts of the discharge vessel. A third possible use of the selection means is the alternate selection of all the electrode bodies and none of them so that alternately the discharge with a maximal size and no discharge at all are present between the main electrodes in the lamp. This latter possibility makes the lighting arrangement very suitable for use as e.g. a blinking light or a brake light in an automobile.

It has been found that the ignition behavior of the lamp in a lighting arrangement according to the invention can be further improved by covering the dielectric sheet with a layer comprising a material with a secondary electrode emission coefficient that is larger than or equal to 0.1. This layer can for instance be formed by a phosphor layer comprising grains of luminescent material that are coated with a material with a high secondary electrode emission coefficient.

Similarly, in embodiments in which the second main electrode is not covered with a dielectric material, the ignition behavior can also be further improved by covering the second main electrode with a layer comprising a material with a secondary electrode emission coefficient that is larger than or equal to 0.1. Good results have been obtained in case the layer(s) comprise(s) one or more of the following compounds, wherein the layer comprises one or more of the following compounds: MgO, SiO2, Y2O3, La2O3, CeO2, SrO, CaO, MgF, LiF, CaF2.

A preferred embodiment of a dielectric barrier discharge lamp for use in a lighting arrangement according to the invention comprises

- a tubular discharge vessel formed out of glass with spherical end portions enclosing a discharge space and comprising a filling,
- a first main electrode comprising an electrically conductive layer covering the outside surface of the discharge vessel,
- a second main electrode comprising a metallic wire that penetrates the discharge vessel
- at one of the spherical end portions and extends up to the second spherical end portion, wherein the diameter of the metallic wire is smaller than 1 mm, preferably smaller than 0.5 mm. In this preferred embodiment the glass wall of the discharge vessel forms a dielectric sheet. Because of the relatively small diameter of the metallic wire, only a relatively low amplitude voltage is necessary to generate a corona discharge between the wire and surrounding filling.

DETAILED DESCRIPTION OF THE PREFERRED EMBODIMENTS

Figure 1:
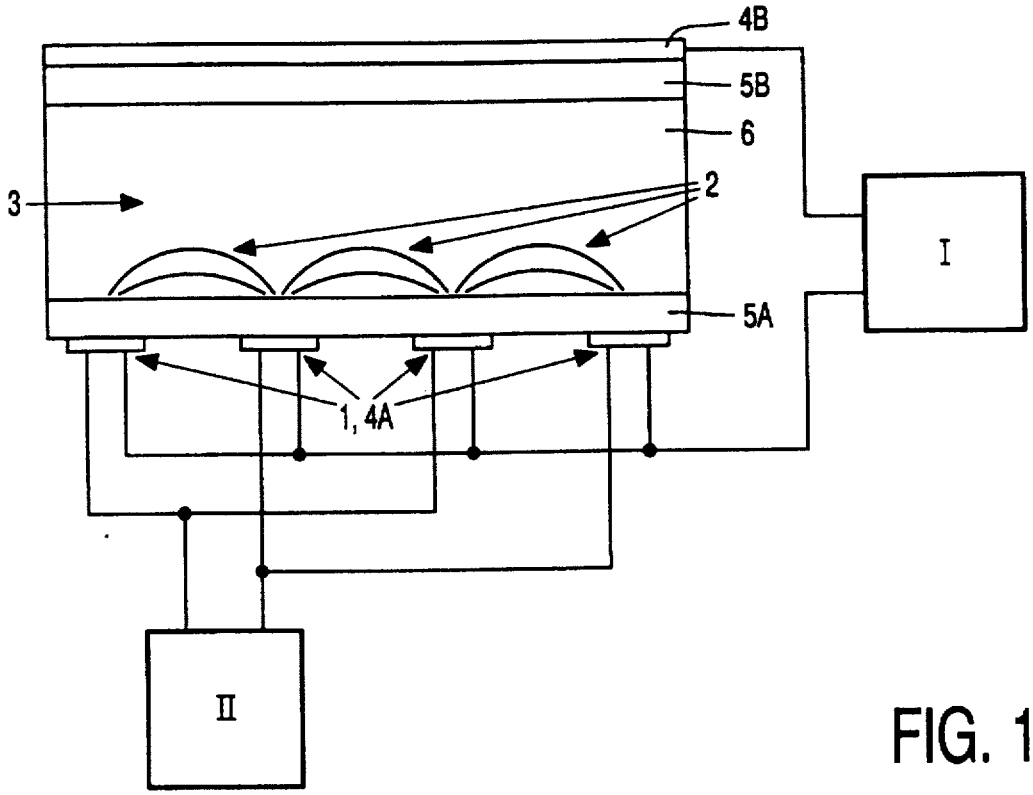
FIG. 1 is a schematic of a first embodiment of the lighting apparatus.

In FIG. 1, a flat gas tight discharge vessel 6 encloses a discharge space 3 containing a filling. A first main electrode 4*a* and a second main electrode 4*b* are situated on the outside of the discharge vessel. Dielectric sheets 5*a* and 5*b* that cover the inner surface of the discharge vessel where the outside surface is covered by the main electrodes and are therefore situated between the main electrodes and the discharge space. The first main electrode 4*a* comprises a number of segments. In this embodiment each of the segments of the first main electrode forms an electrode body and all the electrode bodies together form auxiliary electrode means 1. The first main electrode is connected to a first output terminal of circuit part I for generating an operating voltage. The second main electrode is connected to a second output terminal of circuit part I. Circuit part II is a second circuit part for generating an auxiliary discharge in the discharge space. The segments of the first main electrode are alternately connected to a first output terminal of circuit part II and a second output terminal of circuit part II.

The operation of the embodiment shown in FIG. 1 is as follows.

After the embodiment is switched on, circuit part I generates an operating voltage that is present between the two main electrodes. At the same time circuit part II generates an auxiliary voltage that is present between each of the first main electrode segments and its neighbouring segment(s). Since neighbouring segments are relatively close together, the auxiliary voltage immediately upon application generates a discharge between each pair of neighbouring segments. These discharges together form an auxiliary discharge 2 generating free electrons and other charged particles. Because of the presence of these free electrons and charged particles, the operating voltage can reliably ignite the lamp, in other words generate a discharge between the two main electrodes. After the discharge between the two main electrodes has been established by the operating voltage for the first time, the lamp is operated during stationary operation by means of a high frequency alternating current that is generated out of the operating voltage. The lamp needs to be reignite at the beginning of each half period of the high frequency current. For this reason the auxiliary discharge is constantly maintained during stationary operation by circuit part II. Because of the free electrons and other charged particles generated by the auxiliary discharge the lamp reignite very reliably making use of an operating voltage with a relatively low amplitude.

Figure 2:
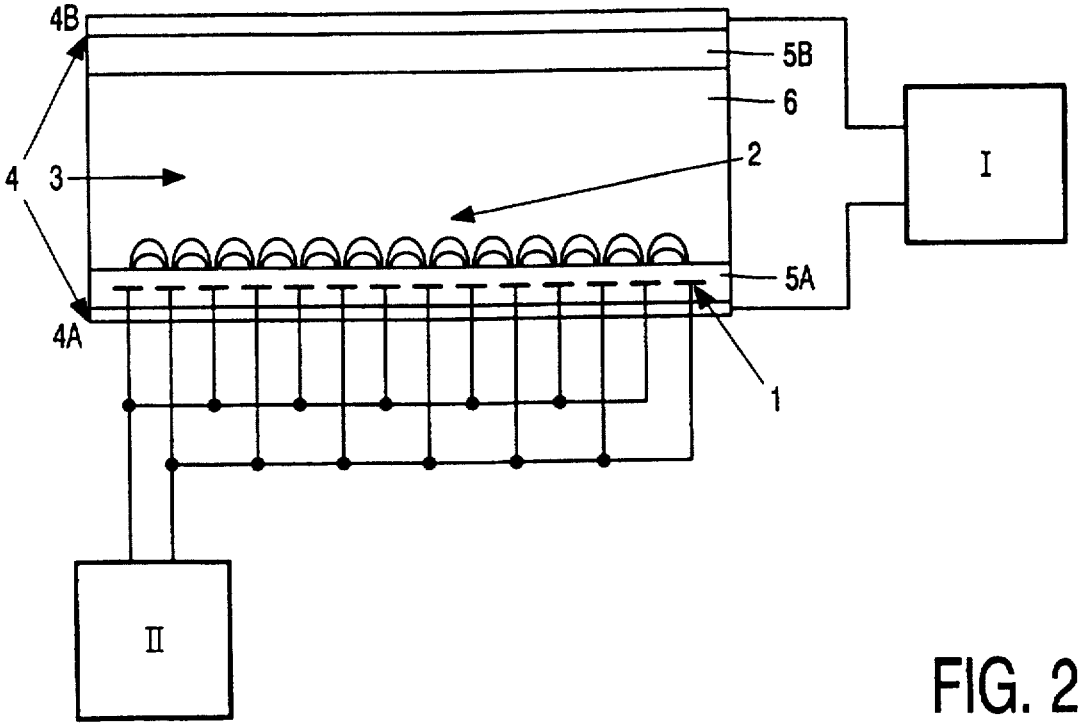
FIG. 2 is a schematic of a second embodiment.
Figure 3:
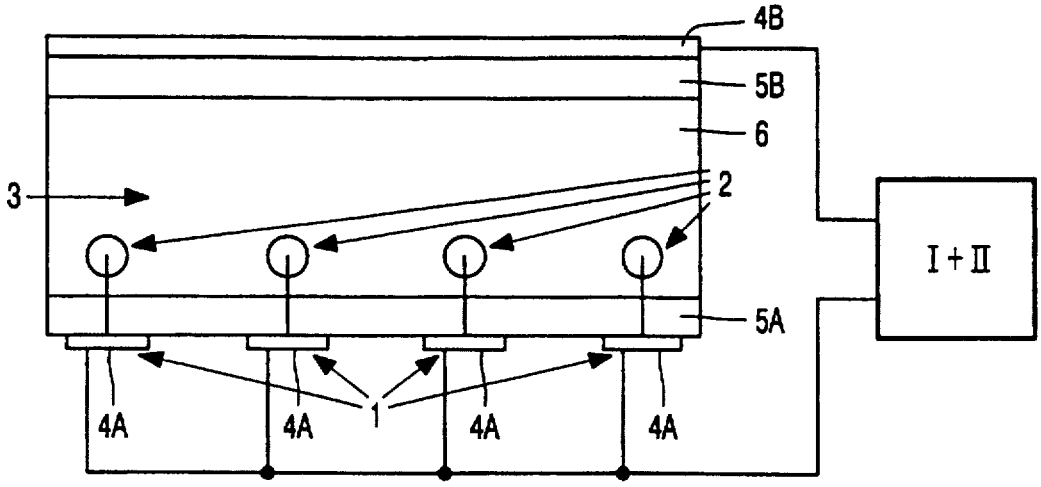
FIG. 3 is a schematic of a third embodiment.
Figure 4:
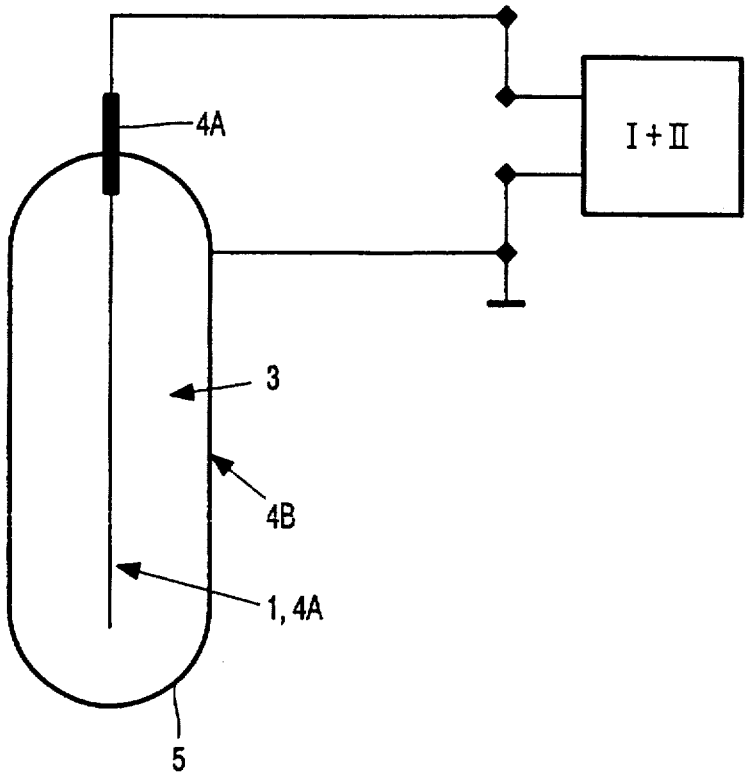
FIG. 4 is a schematic of a fourth embodiment.

In the embodiments shown in FIGS. 2, 3 and 4 parts of the lamp and the circuitry that are similar to parts of the embodiment shown in FIG. 1 are indicated by means of the same reference numerals as used in FIG. 1. The important difference between the embodiment shown in FIG. 2 and the embodiment shown in FIG. 1 is that the auxiliary electrode means 1 comprises a number of electrode bodies that are separate from the first main electrode, in other words not formed by segments of the first main electrode. These electrode bodies are completely surrounded by the dielectric sheet 5*a* that is situated between the first main electrode and the discharge space. The number of electrode bodies is chosen relatively large and they are evenly distributed over the dielectric sheet so that they do not deteriorate the homogeneity of the discharge. The electrode bodies are alternately connected to a first and a second output terminal of circuit part II. These connections are through the first main electrode and isolated from it. The operation of the embodiment shown in FIG. 2 is very similar to that of the embodiment shown in FIG. 1 and will not be described separately.

In the embodiment shown in FIG. 3 the first main electrode is segmented, and each of the segments is electrically and mechanically connected to an electrode body. Each of the electrode bodies protrude through the wall of the discharge vessel and the dielectric sheet 5*a* into the discharge space. The segments and therefore also the electrode bodies are evenly distributed over the surface of the wall of the discharge vessel that is covered by the first electrode. The first main electrode is connected to a first output terminal of a circuit part I+II for generating an operating voltage and for generating an auxiliary voltage. The second main electrode is connected to a second output terminal of the circuit part I+II.

The operation of the embodiment shown in FIG. 3 is as follows.

After the embodiment has been switched on the circuit part I+II generates an operating voltage that is present between the two main electrodes. At the same time the voltage at the electrode segments of the first main electrode (and therefore also the auxiliary voltage present at the electrode bodies 1) is maintained at such a level with respect to the potential of the filling in the discharge vessel that corona discharges are established between the electrode bodies 1 and the surrounding filling in the discharge space. These corona discharges generate charge carriers facilitating the ignition of the lamp. After the lamp has ignited for the first time, it is operated by means of a high frequency AC current generated out of this operating voltage. The lamp needs to be reignite at the beginning of each half period of the high frequency current. For this reason the auxiliary discharge is constantly maintained during stationary operation by circuit part I+II. Because of the free electrons and other charged particles generated by the auxiliary discharge the lamp reignite very reliably making use of an operating voltage with a relatively low amplitude.

In the embodiment shown in FIG. 4, the shape of the discharge vessel is not flat but tubular with spherical end portions. The discharge vessel is formed out of glass. The outside surface of the wall is covered with an electrically conductive layer that forms the first main electrode. The glass wall of the discharge vessel functions as a dielectric sheet. The second main electrode consists of a thin straight metallic wire that penetrates the wall of the discharge space at one of the spherical end portions and extends along the axis of the discharge vessel up to the second spherical end portion. In this embodiment the second main electrode also forms the auxiliary electrode means. The discharge vessel contains a filling. The first main electrode is connected to a first output terminal of a circuit part I+II for generating an operating voltage and for generating an auxiliary voltage. The second main electrode is connected to a second output terminal of the circuit part I+II.

The operation of the embodiment shown in FIG. 4 is as follows.

After the embodiment has been switched on the circuit part I+II generates an operating voltage that is present between the two main electrodes. At the same time the voltage of the second main electrode is maintained at such a level with respect to the potential of the filling in the discharge vessel that a corona discharge is established between the electrode body 1 (formed by the second main electrode) and the surrounding filling in the discharge space. This corona discharge generates charge carriers facilitating the ignition of the lamp by means of the operating voltage. After the lamp has ignited the lamp is operated by means of a high frequency current generated out of the operating voltage. Also in this case the auxiliary discharge is maintained during stationary operation to ensure reliable reignition at the beginning of each half period of the high frequency current.

In a first practical embodiment of a lighting arrangement according to the invention of the type shown in FIG. 2, the discharge vessel was formed out of borosilicate glass. The main electrodes were formed by indium tin oxide layers of ca. 100 nm thickness. The length and the width of the electrodes were both 40 mm and the electrode distance was 5 mm. The filling consisted of 300 mbar of xenon. The electrode bodies of the auxiliary electrode means were formed by indium tin oxide bands with a width of 200 micrometer and a thickness of 100 nanometer. The bands were applied to the inside surface of the discharge vessel over the whole area over which the outside surface of the discharge vessel is covered by one of the main electrodes. The distance between neighbouring bands was 100 micrometer. The electrode bodies were covered by a glass frit with a thickness of 10 micrometer. This frit functioned as a dielectric sheet and had a dielectric constant of approximately 10. On top of the frit was a luminescent layer with a thickness of a few micrometer. The luminescent layer consisted of luminescent grains coated with MgO. The auxiliary voltage that was necessary to maintain an auxiliary discharge between two neighbouring electrode bodies was approximately 300 V. Without the auxiliary discharge the ignition voltage had an amplitude of approximately 6500 V. The auxiliary discharge reduced the amplitude of the ignition voltage to approximately 4500 V. Furthermore the main discharge was found to be evenly distributed and reliable.

In a second practical embodiment of a lighting arrangement according to the invention the dielectric barrier discharge lamp differed only from the one used in the first practical embodiment in the construction of the auxiliary electrode means. The bands of indium tin oxide were absent but a thin metallic wire (stainless steel of 0.5 mm thickness) penetrates into the discharge space and is electrically connected to one of the main electrodes. In case the metallic wire was maintained at a voltage that was 1500 V lower than the potential of the filling, a corona discharge was established between the metallic wire and the surrounding filling. By means of this corona discharge the ignition voltage of the lamp was reduced from approximately 6500 V to approximately 5200 V. Also in this second practical embodiment the ignition was found to be very reliable and not delayed.

In a third practical embodiment of a lighting arrangement according to the present invention the dielectric barrier discharge lamp was of the type shown in FIG. 4. The diameter of the discharge vessel is 20 mm and the vessel is formed out of borosilicate glass. The filling is 300 mbar xenon. The first electrode is formed by a coating of indium tin oxide that has a thickness of approximately 100 nanometer and extends over the whole of the outside surface of the discharge vessel. The borosilicate glass functions as a dielectric sheet. The second main electrode is formed by a stainless steel wire with a diameter of 0.5 mm. Like in the second practical embodiment, it was necessary to maintain the stainless steel wire at a voltage that was 1500 V lower than the potential of the filling to establish a corona discharge between this wire and the surrounding filling. The corona discharge reduced the ignition voltage from approximately 6500 V to approximately 3000 V. For this third practical embodiment the ignition was found to be reliable and homogeneous.

In all three practical embodiments the frequency of the operating voltage was chosen in the range 1 kHz–50 kHz.

What is claimed is:

1. Lighting arrangement equipped with a dielectric barrier discharge lamp comprising a gas tight discharge vessel enclosing a discharge space and containing a filling, a first main electrode, a second main electrode, and auxiliary electrode means having a plurality of electrode bodies along a same side of said gas tight discharge vessel, a dielectric sheet situated between the first main electrode and the discharge space, and a circuit arrangement coupled to the main electrodes for igniting and operating the dielectric barrier discharge lamp, comprising a first circuit part for generating an operating voltage that is present between the two main electrodes, and a second circuit part coupled to the auxiliary electrode means for generating an auxiliary discharge in the discharge space.

2. Lighting arrangement according to claim 1, wherein the auxiliary electrode means comprises a number n of said electrode bodies, n being bigger than or equal to 2, and wherein the second circuit part comprises means for generating n−1 auxiliary voltages that are present between neighbouring electrode bodies and during operation cause a discharge to be present between the neighbouring electrode bodies.

3. Lighting arrangement according to claim 1, wherein the auxiliary electrode means comprises a number n of said electrode bodies, and wherein the second circuit part comprises means for generating n auxiliary voltages that are present between the electrode bodies and the surrounding discharge space and that during operation of the lighting arrangement cause a corona discharge to take place between the electrode bodies and the surrounding discharge space.

4. Lighting arrangement according to claim 3, wherein the electrode bodies are mounted on the dielectric sheet.

5. Lighting arrangement according to claim 4, wherein the electrode bodies are evenly distributed over the dielectric sheet.

6. Lighting arrangement according to claim 4, wherein the electrode bodies protrude from the dielectric sheet into the discharge space.

7. Lighting arrangement according to claim 4, wherein the electrode bodies are separated from the discharge space by means of the dielectric sheet.

8. Lighting arrangement according to claim 1, wherein one of the main electrodes comprises electrode segments and the electrode bodies are formed by the electrode segments.

9. Lighting arrangement according to claim 3, wherein one of the main electrodes comprises n electrode segments and each of the electrode bodies is electrically connected to an electrode segment.

10. Lighting arrangement according to claim 9, in which n=1.

11. Lighting arrangement equipped with a dielectric barrier discharge lamp comprising:

a gas tight discharge vessel enclosing a discharge space and containing a filling, a first main electrode, a second main electrode, and auxiliary electrode means, said auxiliary electrode means comprising electrode bodies, a dielectric sheet situated between the first main electrode and the discharge space, and a circuit arrangement coupled to the main electrodes for igniting and operating the dielectric barrier discharge lamp, comprising:

a first circuit part for generating an operating voltage that is present between the two main electrodes, and a second circuit part coupled to the auxiliary electrode means for generating auxiliary voltages between the electrode bodies and the discharge space, wherein the second circuit part comprises selection means for selecting a number of said electrode bodies and for coupling the auxiliary voltages to the selected electrode bodies.

12. Lighting arrangement according to claim 1, wherein the dielectric sheet is covered with a layer comprising a material with a secondary electrode emission coefficient higher than or equal to 0.1.

13. Lighting arrangement according to claim 12, wherein the layer comprises one or more of the following compounds: MgO, SiO2, Y2O3, La2O3, CeO2, SrO, CaO, MgF, LiF, CaF2.

14. Lighting arrangement according to claim 1, wherein the second main electrode is covered with a layer comprising a material with a secondary electrode emission coefficient is higher than or equal to 0.1.

15. Lighting arrangement according to claim 14, wherein the layer comprises one or more of the following compounds: MgO, SiO2, Y2O3, La2O3, CeO2, SrO, CaO, MgF, LiF, CaF2.

16. Dielectric barrier discharge lamp comprising a tubular discharge vessel formed out of glass with spherical end portions enclosing a discharge space and comprising a filling, a first main electrode comprising an electrically conductive layer covering the outside surface of the discharge vessel, a second main electrode comprising a metallic wire that penetrates the discharge vessel at one of the spherical end portions and extends up to the second spherical end portion, wherein the diameter of the metallic wire is smaller than 1 mm, and a circuit arrangement coupled to the first and second main electrodes for igniting and operating the dielectric barrier discharge lamp, said circuit arrangement generating an operating voltage and an auxiliary discharge in the discharge space between the first and second main electrodes.

17. Lighting arrangement as in claim 2 wherein the electrode bodies are mounted on the dielectric sheet.

18. Lighting arrangement equipped with a dielectric barrier discharge lamp comprising:

a gas tight discharge vessel enclosing a discharge space and containing a filling, a first main electrode, a second main electrode, and auxiliary electrode means, said auxiliary electrode means comprising electrode bodies, a dielectric sheet situated between the first main electrode and the discharge space, and a circuit arrangement coupled to the main electrodes for igniting and operating the dielectric barrier discharge lamp, comprising:

a first circuit part for generating an operating voltage that is present between the two main electrodes, and a second circuit part coupled to the auxiliary electrode means for generating auxiliary voltages between neighboring ones of said electrode bodies, wherein the second circuit part comprises selection means for selecting a number of said electrode bodies and for coupling the auxiliary voltages to the selected electrode bodies.

19. A lamp comprising:

a gas tight discharge vessel enclosing a discharge space and containing a filling;

a first main electrode and a second main electrode, a dielectric sheet situated between the first main electrode and the discharge space;

an auxiliary electrode having a plurality of electrode bodies along a same side of said gas tight discharge vessel; and a circuit arrangement coupled to the first and second main electrodes for igniting and operating the lamp by generating an operating voltage between the first and second main electrodes, said circuit arrangement further being coupled to the auxiliary electrode for generating an auxiliary discharge in the discharge space.

20. The lamp of claim 19, wherein one of said first and second main electrodes is segmented to form said electrode bodies of said auxiliary electrode, said auxiliary discharge reducing said operating voltage.

* * * * *